US005924936A

United States Patent [19]

Penley

[11] Patent Number: 5,924,936

[45] Date of Patent: Jul. 20, 1999

[54] INDIVIDUALLY MATCHED SET OF CLUB SHAFTS AND A METHOD FOR MANUFACTURING AN INDIVIDUALLY MATCHED SET OF CLUB SHAFTS

[75] Inventor: Carter Penley, San Diego, Calif.

[73] Assignee: Penley Sports, L.L.C., San Diego, Calif.

[21] Appl. No.: 08/950,967

[22] Filed: Oct. 15, 1997

[51] Int. Cl.[6] ..... A63B 53/10

[52] U.S. Cl. ..... 473/289; 473/319; 273/DIG. 7; 273/DIG. 23

[58] Field of Search ..... 473/316–323, 473/409, 287–291; 273/DIG. 7, DIG. 23

[56] References Cited

U.S. PATENT DOCUMENTS

| | | | |
|---|---|---|---|
| D. 377,675 | 1/1997 | Abel . | |
| 2,250,428 | 7/1941 | Vickery | 473/289 |
| 2,460,445 | 2/1949 | Bigler . | |
| 2,652,256 | 9/1953 | Thomas . | |
| 2,932,515 | 4/1960 | May . | |
| 3,921,984 | 11/1975 | Winter . | |
| 4,097,626 | 6/1978 | Tennent | 473/319 |
| 4,169,595 | 10/1979 | Kaugars | 473/323 |
| 4,194,739 | 3/1980 | Thompson . | |
| 4,555,112 | 11/1985 | Masghati | 473/289 |
| 4,563,007 | 1/1986 | Bayliss | 473/289 |
| 4,736,951 | 4/1988 | Grant . | |
| 4,757,997 | 7/1988 | Roy | 473/319 |
| 5,022,652 | 6/1991 | Fenton | 473/323 |
| 5,042,815 | 8/1991 | Sutton . | |
| 5,093,162 | 3/1992 | Fenton | 473/319 |
| 5,106,087 | 4/1992 | Simmons | 473/287 |
| 5,192,073 | 3/1993 | Iwanaga | 473/289 |
| 5,253,869 | 10/1993 | Dingle et al. . | |
| 5,390,919 | 2/1995 | Stubbs et al. . | |
| 5,435,562 | 7/1995 | Stock et al. . | |
| 5,685,783 | 11/1997 | Akatsuka | 473/319 |

*Primary Examiner*—Steven Wong
*Assistant Examiner*—Stephen L. Blau
*Attorney, Agent, or Firm*—Nydegger & Associates

[57] ABSTRACT

A method for manufacturing a plurality of club shafts for an individually matched set of golf clubs is provided herein. The method includes using a specifically designed and separate mandrel for each club shaft of the matched set. Further, the method includes sequentially wrapping a specifically designed and separate group of patterns around each mandrel for each club shaft of the matched set. This procedure allows the manufacturer to specifically design each club shaft of the set of golf clubs. The resulting individually matched set of golf clubs has more consistent feel, flexure, frequency, weighting and torque characteristics. Additionally, the club shafts provided herein have improved swing weight characteristics for lighter heads.

16 Claims, 4 Drawing Sheets

INDIVIDUALLY MATCHED SET OF CLUB SHAFTS AND A METHOD FOR MANUFACTURING AN INDIVIDUALLY MATCHED SET OF CLUB SHAFTS

FIELD OF THE INVENTION

The present invention is directed to club shafts for golf clubs. More specifically, the present invention is directed to an individually matched set of club shafts having more consistent feel, flexure, frequency, and torque characteristics and a method for manufacturing the same.

BACKGROUND

The game of golf is becoming increasingly popular in the United States and internationally. Presently, golf players, both professional and non-professional, are continuously striving to improve their golf game. As a result thereof, there is a large market for golf equipment which helps the player improve their golf game. For example, it is well known that the physical characteristics of the club shaft of a golf club can effect the travel of the golf ball. It is also well known that graphite club shafts typically have a higher stiffness to weight ratio, lower shaft vibration, and are more resilient to fatigue than steel club shafts. Accordingly, many golfers are switching from steel club shafts to graphite club shafts.

Recently, some manufacturers have begun matching the frequency of the graphite club shafts in a set of golf clubs so that all of the golf clubs in the set have a good and consistent feel. Additionally, matching the frequency of the club shafts can allow the golfer to have better distance control and dispersion pattern control during play.

One way of matching the frequency of club shafts involves initially manufacturing a number of club shafts in the same fashion. Stated another way, a club shaft for a No. 1 iron is initially manufactured the same as a club shaft for a No. 9 iron. Subsequently, selected amounts of each club shaft are removed from the shaft butt section or the shaft tip section, or weight is added to match the frequency of the club shafts in the set.

However, this process is not entirely satisfactory because each club shaft must be individually frequency tested to determine how much club shaft should be removed or how much weight should be added to the club shaft to match the frequency for the set. Further, using this process, it is very difficult to replicate or replace a damaged club shaft in a set without re-testing the other club shafts in the set.

Additionally, most graphite club shafts are lighter than comparable steel club shafts. Therefore, the graphite club shafts have a lower swing weight than a comparable steel club shaft. One way of increasing the swing weight of graphite club shafts is to add lead tape, or weights to the head, or add lead powder or slugs into the club shaft. However, the lead tape, slugs, or weights frequently become loose and alter the desired swing of the club shaft. Another way of increasing the swing weight is to increase the wall thickness of the graphite club shaft. However, the resulting thicker walled club shaft is often too stiff.

In light of the above, it is an object of the present invention to provide a method for manufacturing a set of club shafts that allows the player to have increased control over the dispersion pattern and more distance control during play. Yet another object of the present invention is to provide a method for manufacturing a set of club shafts which give the player better control over ball spin. Still another object of the present invention is to provide a set of club shafts which do not have to be individually flex tested and/or frequency tested in order to provide an individually matched set of club shafts. Another object of the present invention is to provide a method for controlling the frequency of the club shafts without adding weight to the head or club shaft, or cutting of the club shafts. Yet another object of the present invention is to provide a graphite club shaft having improved swing weight and performance characteristics.

SUMMARY

A method for manufacturing a plurality of club shafts for a matched set of golf clubs is provided herein. The method includes the steps of: (i) providing a plurality of mandrels; (ii) providing a plurality of groups of patterns, each group corresponding to a particular mandrel; and (iii) forming the club shafts by wrapping the patterns of each group around the corresponding mandrel for each group. Importantly, each mandrel and each group of patterns is specifically designed for a particular club shaft in the set of golf clubs. The resulting matched set of golf clubs has more consistent flexure, frequency, and torque characteristics.

The term "match the frequency" when referring to a set of club shafts or golf clubs shall mean that the shaft frequency measured at the tip for each of the club shafts in the set increases for successively higher numbered golf clubs. For example, the No. 1 club shaft has a slightly lower frequency than the No. 2 club shaft, while the No. 2 club shaft has a slightly lower frequency than the No. 3 club shaft.

The term "matched set" as used herein, when referring to a set of golf clubs or a set of club shafts shall mean and include golf clubs or club shafts manufactured by a single manufacturer with the intended purpose to be sold, advertised, and/or used as a set or a unit.

The present invention has recognized the need to specifically design and manufacture each club shaft in the set of golf clubs individually. Each club shaft includes a shaft butt section, a shaft tip section, and a shaft tapered section. As provided herein, a No. 1 iron made in accordance with the present invention will have a shaft butt section, a shaft tip section, and a shaft tapered section which differs from a No. 2 iron. Similarly, the No. 2 iron will have a shaft butt section, a shaft tip section, and a shaft tapered section which differs from a No. 3 iron in the set.

Each club shaft manufactured in accordance with the present invention has a substantially tubular shaft. The shaft butt section includes a shaft butt wall thickness and a shaft butt length. The shaft tip section includes a shaft tip wall thickness and the shaft tapered section includes a shaft tapered length. For a set of sequentially numbered club shafts: (i) the shaft tapered length is progressively decreased for successively higher numbered shafts in the set of club shafts to move the moment of inertia towards the shaft tip section; (ii) the shaft tip wall thickness is progressively decreased for successively higher numbered shafts in the set of club shafts; (iii) the shaft butt wall thickness is progressively increased for successively higher numbered shafts in the set of club shafts to increase the stiffness of the club shafts; and (iv) the shaft butt length is progressively increased for successively higher numbered shafts in the set of club shafts to increase the cycles per minute of the club shafts.

In order to accomplish this task, a separate mandrel is specifically dimensioned and specifically dedicated for each particular club shaft and a different group of patterns is specifically dimensioned and specifically dedicated for each club shaft. For example, a different mandrel and a different group of patterns are used to make a club shaft for a No. 3 iron than are used to make a No. 4 iron. Therefore, in order to make a plurality of club shafts for a set of golf clubs, a plurality or a set of mandrels must be used and a plurality or a set of groups of patterns must be used.

Each of the mandrels is an elongated cylindrical rod-like structure which includes: (i) a mandrel butt section with a mandrel butt diameter and a mandrel butt length; (ii) a mandrel tip section with a mandrel tip diameter; and (iii) a mandrel tapered section with a mandrel tapered length. Each section of each mandrel is specifically designed for one of the club shafts in the set of golf clubs. For example, the mandrel used to make the club shaft for the No. 6 iron is specifically designed and dimensioned for the club shaft of a No. 6 iron.

At least one of the sections of each mandrel differs from one of the sections from another mandrel. Preferably, for a matched set of sequentially number club shafts, the following differences in the sections exists:

(1) the mandrel butt diameter is progressively and substantially linearly reduced for mandrels for successively higher numbered club shafts to progressively increase the shaft butt wall thickness of the resulting club shafts;

(2) the mandrel butt length is progressively and substantially linearly increased for mandrels for successively higher numbered club shafts to progressively increase the shaft butt length of the club shafts;

(3) the mandrel tip diameter is progressively increased for mandrels for successively higher numbered club shafts to progressively decrease the shaft tip wall thickness of the club shafts; and (4) the mandrel tapered section length is progressively and substantially linearly decreased for mandrels of successively higher numbered club shafts to progressively move the moment of inertial of the club shaft towards the shaft tip section.

As provided above, each club shaft is made of a separate group of patterns. Each pattern in the group of patterns has a pattern length specifically dimensioned for the corresponding mandrel of each group. Preferably, for a matched set of sequentially number club shafts, the pattern length is progressively reduced for successively higher numbered club shafts. For example, the group of patterns for the No. 1 iron has a pattern length which is longer than the pattern length for the group of patterns for the No. 2 iron. Similarly, the No. 3 iron has a pattern length which is longer than that of the No. 4 iron and shorter than that of the No. 2 iron. Because each group of patterns is specifically designed for a specific club shaft, minimal, if any, trimming is necessary on the club shaft.

Preferably, the plurality of groups of patterns are sized and shaped so that the resulting club shafts in the matched set have substantially the same weight. This will allow all the golf clubs in the set to have the same feel and swing weight.

The invention is also a method for making golf shafts for a matched set of club shafts. This method includes the steps of: (i) providing first and second mandrels; (ii) providing first and second groups of plurality of patterns; (iii) forming a first club shaft by wrapping the first set of plurality of the patterns around the first mandrel; and (iv) forming a second club shaft by wrapping the second set of plurality of patterns around the second mandrel. In this embodiment, the first club shaft and the second club shaft can each be any one of the club shafts in the matched set. For example, the first club shaft could be for a No. 5 iron while the second club shaft could be for a No. 3 iron.

The invention also includes a method for manufacturing a particular golf club shaft for a matched set of golf clubs. The method includes the steps of: (i) providing a particular group of patterns; (ii) selecting a particular mandrel from a set of mandrels; and (iii) wrapping the patterns from the particular group around the particular mandrel to form the particular club shaft.

Additionally, the present invention is also a method for increasing the swing weight of a club shaft. The method ;includes the step of wrapping at least one weighted section preferably around the mandrel tapered section, proximate the mandrel tip section. The weighted section preferably includes highly loaded carbonyl iron powder or some other metallic material disposed in an epoxy resin film.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
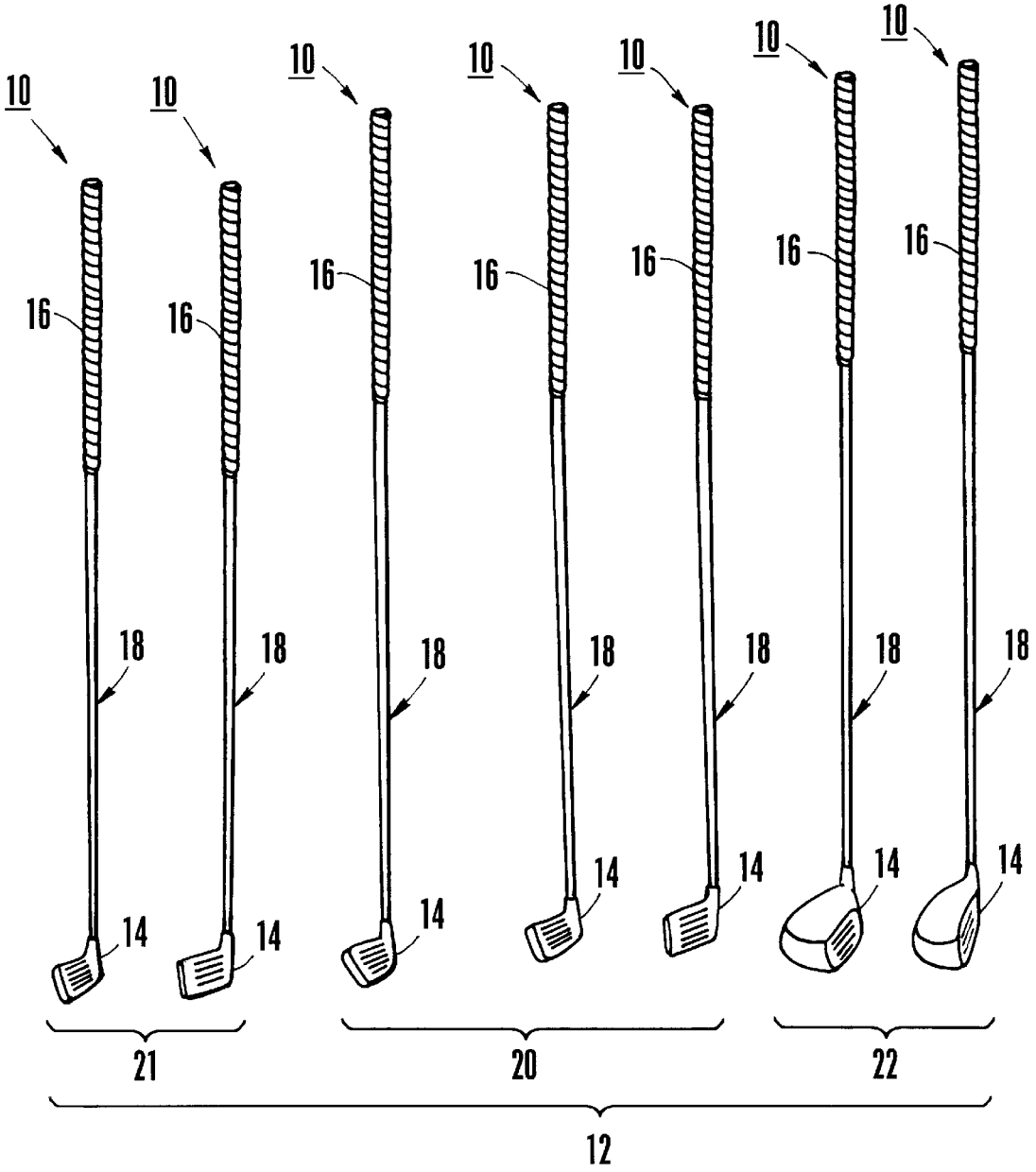
FIG. 1 is a side plan view of a representative set of irons and representative set of woods having features of the present invention.

FIG. 1 displays a plurality of golf clubs 10 for a matched set 12 of golf clubs 10. Each golf club 10 includes a head 14, a grip 16 and a club shaft 18. Importantly, the club shaft 18 for each golf club 10 is uniquely manufactured so that the resulting matched set 12 has more consistent feel, flex, frequency, and torque characteristics. This allows a golf player (not shown) to have better control over flight, trajectory, distance, and ball spin on a golf ball (not shown). Further, these desirable features can be accomplished without individual frequency testing and/or tip cutting each club shaft 18. Moreover, the manufacturing process provided herein allows a club shaft 18 manufacturer to easily replace a damaged club shaft 18 or golf club 10 in the matched set 12.

A typical set 12 of golf clubs 10 includes a set of irons 20, a set of woods 22, one or more wedges 21, and one or more putters (not shown). The actual number of golf clubs 10 in a set 12 of golf clubs can vary. For example, typically, a player in a tournament utilizes a set 12 of golf clubs 10 which includes No. 1 through No. 9 irons 10 and a No. 1, No. 3, and No. 5 woods 22. The irons 20, wedges 21, and woods 22 shown in FIG. 1 are mainly for exemplary purposes only.

Irons 20 have a head 14 which is typically made of metal while woods 22 have a head 14 which is made of metal or wood. Typically, irons 20 and woods 22 are each sequentially numbered in order of increasing loft. For example, a set 12 of golf clubs can include a set of nine (9) irons 20, sequentially numbered No. 1 iron through No. 9 iron. Similarly, the set 12 of golf clubs can include a set of five (5) or more woods 22, sequentially numbered, for example, No. 1 wood through No. 5 wood. However, it is conceivable that the golf clubs 10 may be designated or numbered in an alternate fashion or that some of the irons 20 or woods 22 may not be included in the set 12 of golf clubs.

Importantly, the present invention recognizes that the physical characteristics of each club shaft 18 is largely dependent upon the manufacturing process used to make the club shaft 18, the material utilized to make the club shaft 18, and the final dimensions of the club shaft 18. The club shafts 18 provided herein are superior to prior art club shafts because the manufacturing process, the materials utilized, and the dimensions of each club shaft 18 have been specifically tailored for each specific club shaft 18.

Figure 2:
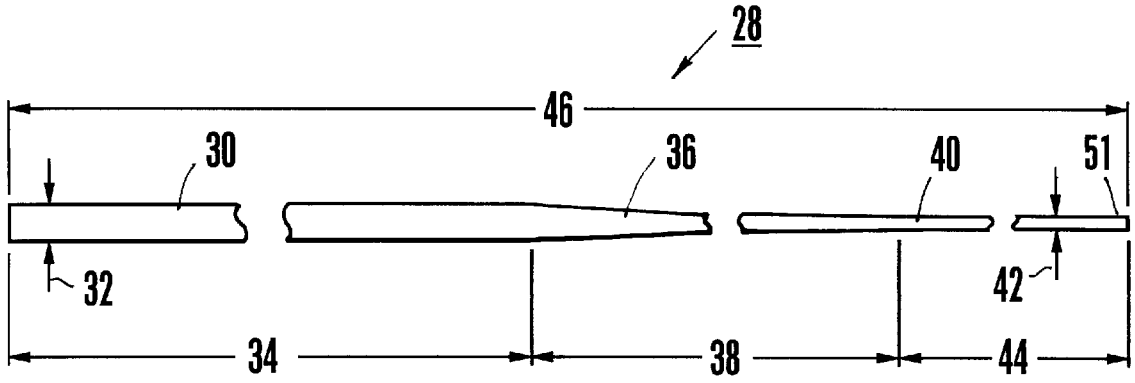
FIG. 2 is a side plan view of a mandrel useful for manufacturing club shafts in accordance with the present invention.

As provided herein, the club shafts 18 can be made by sequentially wrapping weighted segments 23 (shown in FIG. 3) and patterns 24 (shown in FIG. 4) from a group 26 of patterns onto a mandrel 28 (shown in FIG. 2). Importantly, a different mandrel 28 is used to make each separate club shaft 18 of the set 12. For example, nine (9) separate mandrels 28 are required to make a set of irons 20 including nine (9) irons.

FIG. 2 depicts a mandrel 28 that is representative of mandrels 28 which can be used to manufacture club shafts 18 in accordance with the present invention. The mandrel 28 is substantially rod shaped and has a circular cross-section. The mandrel 28 includes a mandrel butt section 30 having a mandrel butt diameter 32 and a mandrel butt length 34, a mandrel tapered section 36 having a mandrel tapered length 38, and a mandrel tip section 40 having a mandrel tip diameter 42 and mandrel tip length 44. The mandrel tapered section 36 attaches the mandrel butt section 30 and the mandrel tip section 40. The mandrel tapered section 36 can taper substantially linearly from the Mandrel butt section 30 to the mandrel tip section 40.

Table A, below, provides an exemplary listing of the dimensions of mandrels 28 used to make a matched set of irons 20 in accordance with the present invention. An overall mandrel length 46 is also provided in Table A. It should be recognized that the dimensions provided below are for a set of club shafts 18 for a tournament player. Importantly, the dimensions of the mandrels 28 can be varied to change the performance characteristics of the club shaft 18. For example, a set of irons 20 for a woman would require a different set of mandrels 28. Similarly, a set of irons 20 for a senior player would also require a different set of mandrels 28. Moreover, a set of woods 22 would also require a different set of mandrels 28, namely, a separate mandrel 28 for each wood 22 in the set.

TABLE A

| Golf Club Designation | Mandrel Length 46 (inches) | Mandrel Butt Length 34 (inches) | Mandrel Tapered Length 38 (inches) | Mandrel Tip Length 44 (inches) | Mandrel Butt Diameter 32 (inches) | Mandrel Tip Diameter 42 (inches) |
|---|---|---|---|---|---|---|
| No. 1 Iron | 52 | 17 | 30 | 5 | .495 | .160 |
| No. 2 Iron | 52 | 18 | 29 | 5 | .490 | .165 |
| No. 3 Iron | 52 | 19 | 28 | 5 | .485 | .170 |
| No. 4 Iron | 52 | 20 | 27 | 5 | .480 | .175 |
| No. 5 Iron | 52 | 21 | 26 | 5 | .475 | .180 |
| No. 6 Iron | 52 | 22 | 25 | 5 | .470 | .185 |
| No. 7 Iron | 52 | 23 | 24 | 5 | .465 | .190 |
| No. 8 Iron | 52 | 24 | 23 | 5 | .460 | .195 |
| No. 9 Iron | 52 | 25 | 22 | 5 | .455 | .200 |

The following trends should be noted from Table A:

(1) the mandrel butt diameter 32 progressively decreases substantially linearly for successively numbered club shafts, i.e., from No. 1 iron to the No. 9 iron;

(2) the mandrel butt length 34 progressively increases substantially linearly for successively numbered club shafts, i.e., from the No. 1 iron to the No. 9 iron;

(3) the mandrel tapered length 38 progressively decreases substantially linearly from the No. 1 iron to the No. 9 iron to move the moment of inertia of the club shaft towards the tip; and (4) the mandrel tip diameter 42 is progressively increased substantially linearly from the No. 1 iron to the No. 9 iron.

Typically, the weighted segments 23 are sequentially wrapped around the mandrel tapered section 36, proximate the mandrel tip section 40. Alternately, the weighted segments 23 can be wrapped on or proximate the mandrel tip section 40. The weighted segments 23 are designed to add swing weight to the club shaft 18 and move the balance point of the club shaft 18. Therefore, the weighted segments 23, preferably, have between approximately one hundred percent to one hundred fifty percent (100–150%) more mass than graphite. In the embodiments shown in FIGS. 3*a* and 3*b*, each weighted segment 23 is a thin, approximately 0.005 inches thick, sheet of epoxy resin film. The film is eighty-two percent (82%) loaded with a Carbonyl Iron Powder and is supported with 0.3 ounces NW fiberglass. Suitable weighted segments 23 can be purchased from Bryte Technology in San Jose, Calif. Alternately, each weighted segment 23 can, for example, be another metallic material and/or powder in an epoxy resin film. The examples of weighted segments 23 provided in FIGS. 3*a* and 3*b* are merely exemplary.

Figure 3A:
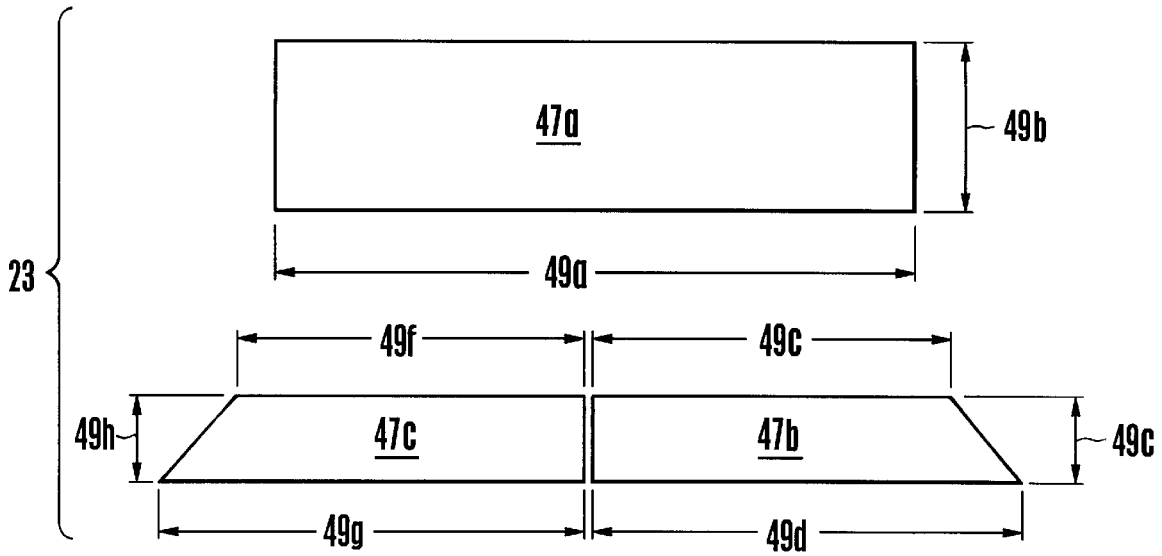
FIG. 3*a* is a side plan view of a plurality of weighted segments having features of the present invention.

The embodiment shown in FIG. 3*a* includes a first weighted segment 47*a*, a second weighted segment 47*b*, and a third weighted segment 47*c*. In this embodiment, the first weighted segment 47*a* has a first segment length 49*a* which is approximately seven inches (7 in.) and a first segment width 49*b* which is approximately two inches (2 in.). The second weighted segment 47*b* has an upper second segment length 49*c* which is approximately four inches (4 in.), a lower second segment length 49*d* which is approximately five inches (5 in.), and a lower second segment width 49*e* which is approximately one inch (1 in.). The third weighted segment 47*c* has an upper third segment length 49*f* which is approximately four inches (4 in.), a lower third segment length 49*g* which is approximately five inches (5 in.), and a lower third segment width 49*h* which is approximately one inch (1 in.).

Figure 3B:
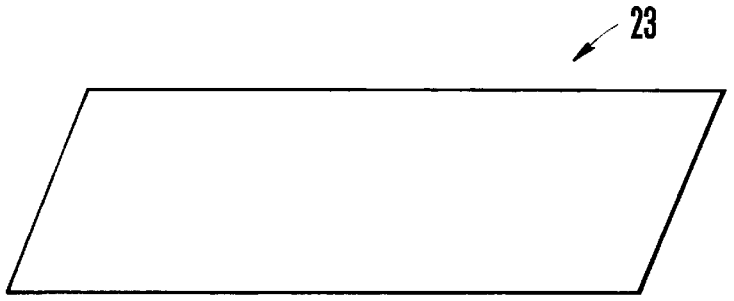
FIG. 3*b* is a side plan view of a weighted segment having features of the present invention.

Alternately, in the embodiment shown in FIG. 3*b,* a single weighted segment 23 is utilized. In this embodiment, the weighted segment 23 is between approximately ten inches (10 in.) to twenty inches (20 in.) in length and between approximately two inches (2 in.) to three inches (3 in.) wide.

Preferably, the weighted segments 23 are positioned on the mandrel tapered section 36, proximate the mandrel tip section 20 to add weight to the club shaft 18 where the weight will most influence the swing weight of the club shaft 18. For example, in the embodiment shown in FIG. 3*a,* the first weighted segment 47*a* is positioned between approximately seven and one-half inches (7.5 in.) to eight and one-half inches (8.5 in.) from a distal end 51 of the mandrel tip section 40. Next, the second weighted segment 47*b* and the third weighted segment 47*c* are subsequently wrapped substantially adjacent each other over the first weighted segment 47*a*. It is important to recognize that the number, dimensions, and positioning of the weighted segments 23 provided herein are for exemplary purposes only and can be varied to alter the performance characteristics of the club shaft 18.

Next, the patterns 24 from the group 26 of patterns are sequentially wrapped around the mandrel 28 over the weighted segments 23 to form the club shaft 18. Each pattern 24 has a pattern length 48, a pattern butt width 50, and a pattern tip width 52. The number of patterns 24, the pattern length 48, pattern butt width 50, and pattern tip width 52 can vary.

Figure 4:
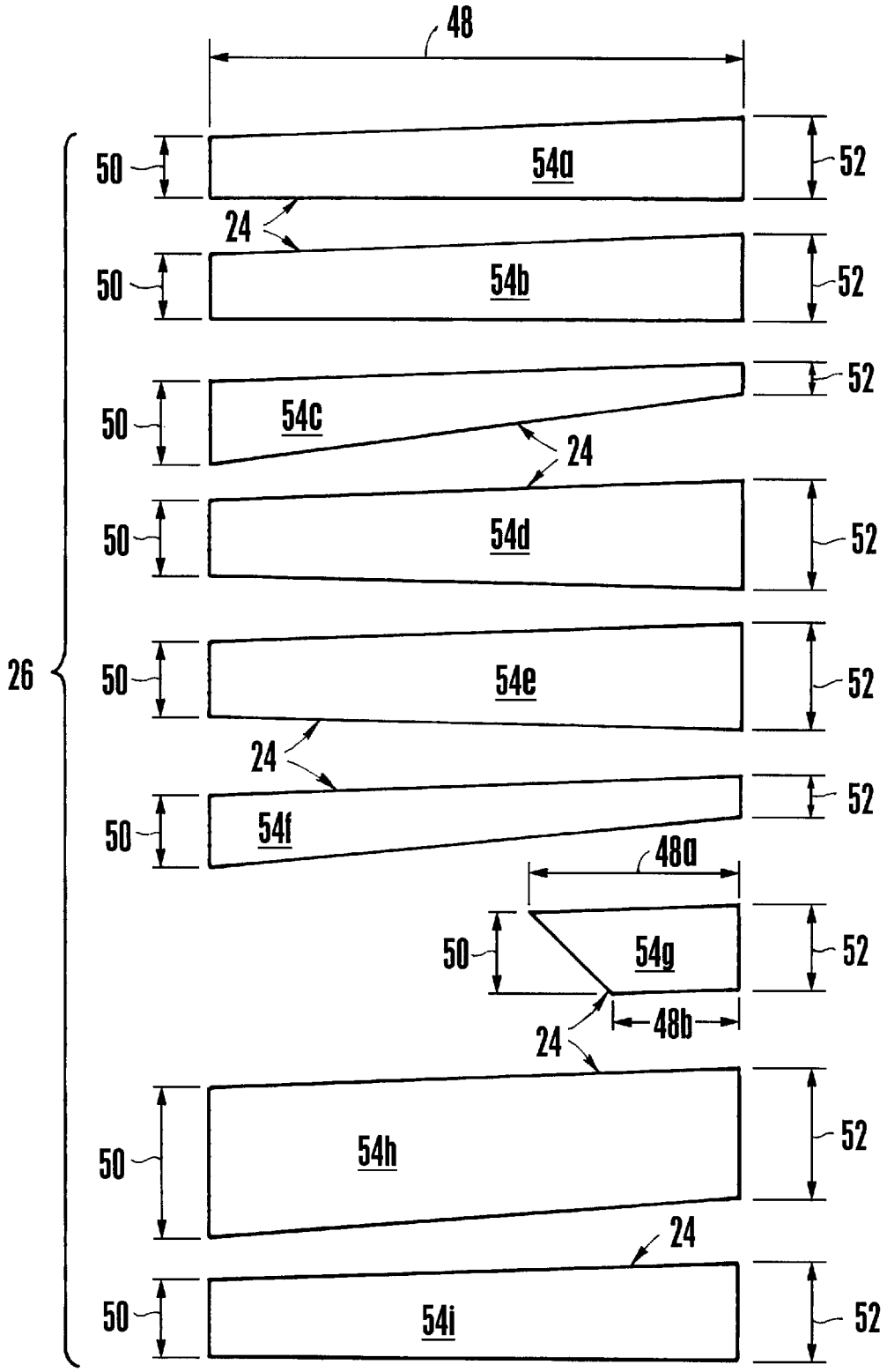
FIG. 4 is a top plan view of a plurality of patterns useful for forming a club shaft in accordance with the present invention.

FIG. 4 shows a representative group 26 of patterns which includes nine (9) separate patterns 54*a* to 54*i*. Each pattern 54*a*–54*i* is a thin sheet having a thickness of between approximately 0.003 inches to 0.008 inches. Each pattern 54*a*–54*i* is preferably impregnated with a resin to hold the patterns 54*a*–54*i* together after heat cure to form the club shaft 18. In this embodiment, the first pattern 54*a,* the second pattern 54*b,* the fourth pattern 54*d,* and the fifth pattern 54*e* are made of a thin sheet of HR40 graphite (±angles). The third pattern 54*c* the sixth pattern 54*f* and the seventh pattern 54*g* are made of high strength glass otherwise known as S-Glass. The eighth pattern 54*h* is made of 34–700 high tensile graphite and the ninth pattern 54*i* is made of high strength graphite. The material for the patterns 54*a*–54*i* can be purchased from Newport Adhesives and Composites, located in Irvine, Calif.

Table B, below, provides a representative listing of the dimensions of a set of groups 26 of patterns which can be used to make a set of irons 20 in accordance with the present invention for a tournament player. It should be recognized that the dimensions and number of patterns 24 provided below are merely exemplary and can vary. For example, an alternate set of patterns will be used for a set of irons 20 or woods 22 for a woman or a senior player. In Table B the numbers 50 and 52, respectively, represent the pattern butt width 50 and the pattern tip width 52.

TABLE B

| Golf | Pattern Length | First Pattern 54a | | Second Pattern 54b | | Third Pattern 54c | | Fourth Pattern 54d | | Fifth Pattern 54e | | Sixth Pattern 54f | | Seventh Pattern 54g | | Eighth Pattern 54h | | Ninth Pattern 54i | |
|---|---|---|---|---|---|---|---|---|---|---|---|---|---|---|---|---|---|---|---|
| Club | 48 | 50 | 52 | 50 | 52 | 50 | 52 | 50 | 52 | 50 | 52 | 50 | 52 | 50 | 52 | 50 | 52 | 50 | 52 |
| No. 1 Iron | 40½ | 1.571 | 1.743 | 1.571 | 1.743 | 1.618 | 0.691 | 1.665 | 2.403 | 1.665 | 2.403 | 3.456 | 1.853 | 1.98 | 1.98 | 3.644 | 3.205 | 1.869 | 2.293 |
| No. 2 Iron | 40 | 1.555 | 1.791 | 1.555 | 1.791 | 1.602 | 0.707 | 1.650 | 2.451 | 1.650 | 2.451 | 3.424 | 1.885 | 2.011 | 2.011 | 3.613 | 3.251 | 1.854 | 1.147 |
| No. 3 Iron | 39½ | 1.540 | 1.838 | 1.540 | 1.838 | 1.587 | 0.723 | 1.634 | 2.498 | 1.634 | 2.498 | 3.393 | 1.916 | 2.042 | 2.042 | 3.581 | 3.299 | 1.838 | 1.162 |
| No. 4 Iron | 39 | 1.524 | 1.532 | 1.524 | 1.532 | 1.571 | 0.707 | 1.618 | 2.000 | 1.618 | 2.000 | 3.361 | 1.822 | 1.848 | 1.848 | 3.550 | 3.157 | 3.676 | 2.262 |
| No. 5 Iron | 38½ | 1.508 | 1.571 | 1.508 | 1.571 | 1.555 | 0.723 | 1.603 | 2.042 | 1.603 | 2.042 | 3.330 | 1.853 | 1.979 | 1.979 | 3.519 | 3.205 | 3.644 | 2.293 |
| No. 6 Iron | 38 | 2.262 | 1.610 | 2.262 | 1.610 | 1.571 | 0.738 | 1.618 | 2.082 | 1.618 | 2.082 | 3.361 | 1.885 | 2.011 | 2.011 | 3.550 | 3.251 | 3.676 | 1.147 |
| No. 7 Iron | 37½ | 2.239 | 1.650 | 2.239 | 1.650 | 1.555 | 0.754 | 1.634 | 2.121 | 1.634 | 2.121 | 3.330 | 1.916 | 2.042 | 2.042 | 3.519 | 3.299 | 3.644 | 1.162 |
| No. 8 Iron | 37 | 2.215 | 1.689 | 2.215 | 1.689 | 1.539 | 0.770 | 2.404 | 2.160 | 2.404 | 2.160 | 3.361 | 1.848 | 2.073 | 2.073 | 3.550 | 2.199 | 3.676 | 1.147 |
| No. 9 Iron | 36½ | 2.191 | 1.728 | 2.191 | 1.728 | 1.524 | 0.785 | 2.380 | 2.199 | 2.380 | 2.199 | 3.330 | 1.979 | 2.105 | 2.105 | 3.519 | 2.231 | 3.644 | 1.162 |

It should be noted from Table B, for a particular club shaft 18, that eight of the nine patterns 24, in each group 26 of patterns has substantially the same pattern length 48. This minimizes the amount of cutting necessary to complete the particular club shaft 18. In the embodiment provided herein, for a particular club shaft 18, the seventh pattern 54*g* is shorter than the other patterns 24 for the club shaft 18 and has an upper short pattern length 48*a* of approximately four and one-half inches (4.5 in.) and a lower short pattern length 48*b* of approximately two and one-half inches (2.5 in.). Further, it should be noted from Table B that the pattern length 48 progressively and substantially linearly decreases for successively lower numbered club shafts 18. This also minimizes the amount of cutting necessary to complete the particular club shaft 18.

Figure 5:
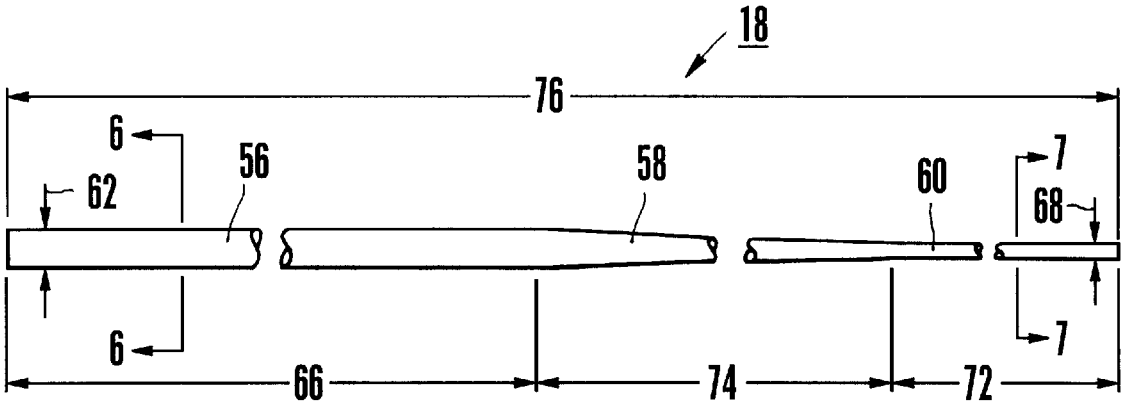
FIG. 5 is a side plan view of a club shaft having features of the present invention.
Figure 6:
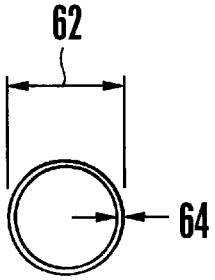
FIG. 6 is an enlarged, cut-away view taken on Line 6—6 of FIG. 5.
Figure 7:
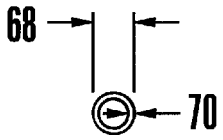
FIG. 7 is an enlarged, cut-away view taken on Line 7—7 of FIG. 5.

Referring to FIGS. 5–7, the club shaft 18 is substantially tubular and includes a shaft butt section 56, a shaft tapered section 58, and a shaft tip section 60. The shaft butt section 56 attaches to the grip 16 while the shaft tip section 60 attaches to the head 14. The shaft butt section 56 is substantially annular and includes a shaft butt outer diameter 62, a shaft butt wall thickness 64, and a shaft butt length 66. The shaft tapered section 58 tapers substantially linearly from the shaft butt section 56 to the shaft tip section 60. The tip section 60 is also substantially annular and includes a shaft tip outer diameter 68, a shaft tip wall thickness 70, and a shaft tip length 72. Table C below, provides a representative listing of the dimensions of a matched set of irons 20 made in accordance with the present invention for a tournament player. It should be recognized that the dimensions provided below are merely exemplary and can be varied. For example, the resulting dimensions for a set 12 of club shafts for a senior player would be different.

TABLE C

| Golf Club | Shaft Butt Outer Diameter 62 inches | Shaft Butt Wall Thickness 64 inches | Shaft Butt Length 66 inches | Shaft Tip Outer Diameter 68 inches | Shaft Tip Wall Thickness 70 inches | Shaft Tip Length 72 inches | Shaft Tapered Length 74 inches | Shaft Length 76 inches |
|---|---|---|---|---|---|---|---|---|
| No. 1 Iron | 0.595 | 0.05 | 8 | 0.37 | 0.105 | 2 | 30 | 40 |
| No. 2 Eron | 0.595 | 0.053 | 8.5 | 0.37 | 0.103 | 2 | 29 | 39.5 |
| No. 3 Iron | 0.595 | 0.058 | 9 | 0.37 | 0.1 | 2 | 27 | 39 |
| No. 4 Iron | 0.595 | 0.058 | 9.5 | 0.37 | 0.098 | 2 | 26 | 38.5 |
| No. 5 Iron | 0.595 | 0.06 | 10 | 0.37 | 0.095 | 2 | 25 | 38 |
| No. 6 Iron | 0.595 | 0.063 | 10.5 | 0.37 | 0.093 | 2 | 24 | 37.5 |
| Na. 7 Iron | 0.595 | 0.065 | 11 | 0.37 | 0.09 | 2 | 23 | 37 |
| No. 8 Iron | 0.595 | 0.068 | 11.5 | 0.37 | 0.088 | 2 | 22 | 36 |
| No. 9 Iron | 0 595 | 0.070 | 12 | 0.37 | 0.085 | 2 | 22 | 36 |

The following trends should be noted from Table C:

(1) the shaft tapered length 74 is progressively decreased for successively higher numbered club shafts 18 in the set of irons 20 to move the moment of inertia toward the shaft tip section 60;

(2) the shaft tip wall thickness 70 is progressively decreased for successively higher numbered club shafts 18 in the set of irons 20;

(3) the shaft butt wall thickness 64 is progressively increased for successively higher numbered shafts 18 in the set of irons 20 to increase the stiffness of the club shafts 18; and (4) the shaft butt length 66 is progressively increased for successively higher numbered club shafts 18 and the set of irons 20 to increase the cycles per minute of the club shafts 18.

Importantly, the manufacturing process provided herein allows the manufacturer to specifically, uniquely tailor the shaft butt section 56, the shaft tapered section 58, and shaft tip section 60 of each club shaft 18 by adjusting the shape of the mandrel 28 and the shape of the patterns 54. This allows the manufacturer to finely tune the club shafts 18 to suit the needs of a particular player.

MANUFACTURE

The manufacturing of one of the club shafts 18, in accordance with the present invention, can best be understood with initial reference to FIGS. 2–4. For exemplary purpose only, this discussion will be directed towards a club shaft 18 for a No. 5 iron. However, the other club shafts 18 in the set 12 can be made utilizing somewhat similar procedures.

Initially, the specific mandrel 28 for the No. 5 iron is selected. Table A provides a listing of the dimensions for this mandrel 28. Next, the first, second, and third weighted segments 47*a*–47*c* are sequentially wrapped around the mandrel tapered section 36. Subsequently, the first pattern 54*a,* the second pattern 54*b,* the third pattern 54*c,* the fourth pattern 54*d,* the fifth pattern 54*e,* the sixth pattern 54*f,* the seventh pattern 54*g,* the eighth pattern 54*h,* and the ninth pattern 54*i* are sequentially wrapped onto the mandrel 28.

Table B provides a listing of the dimensions of the group 26 of patterns specifically designed for a No. 5 iron. Because the patterns 24 of the group 26 of patterns has a pattern length 48 specifically designed for the No. 5 iron, very little, if any material must be cut from the club shaft 18.

Next the mandrel 28 which is wrapped with the weighted segments 23 and the patterns 24 is wrapped with a polypropylene sheet (not shown) and placed into an oven (not shown) for curing. After curing, the polypropylene sheet and the mandrel 28 are removed to form the club shaft 18.

While the particular club shafts 18, as herein shown and disclosed in detail, are fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A method for manufacturing a plurality of club shafts for a set of golf clubs, the method comprising the steps of:

providing a plurality of mandrels, each mandrel including a mandrel butt section, a mandrel tapered section and a mandrel tip section, the mandrel butt section having a substantially constant diameter, the mandrel tip section for each mandrel including an upper section having a substantially constant diameter, each mandrel being dedicated to and having each section specifically dimensioned for one of the club shafts; wherein, the mandrel butt, tapered and tip sections of each mandrel differ from the corresponding mandrel butt, tapered and tip sections from each of the other mandrels;

providing a plurality of groups of patterns, each group of patterns corresponding to one of the mandrels; and forming the club shafts by wrapping the patterns of each group around the corresponding mandrel for each group.

2. The method of claim 1 wherein the step of providing a plurality of groups of patterns includes each group of patterns having a pattern length specifically dimensioned for the corresponding mandrel for each group; wherein the pattern length of one of the groups of patterns differs from the pattern length of at least one other group of patterns.

3. The method of claim 1 wherein the step of providing a plurality of mandrels includes providing mandrels for a sequentially numbered set of golf shafts, the mandrel butt section of each mandrel having a mandrel butt diameter, wherein the mandrel butt diameter of each of the mandrels is progressively decreased at least one-one thousandth of an inch for successively higher numbered shafts.

4. The method of claim 1 wherein the stop of providing a plurality of mandrels includes providing mandrels for a sequentially numbered set of golf shafts, the mandrel tip section of each mandrel having a mandrel tip diameter, wherein the mandrel tip diameter of each mandrel is progressively increased for successively higher numbered shafts.

5. The method of claim 1 wherein the step of providing a plurality of mandrels includes providing mandrels for a sequentially numbered set of golf shafts, the mandrel tapered section for each mandrel having a mandrel tapered length and the mandrel butt section for each mandrel having a mandrel butt length, wherein the mandrel tapered length is progressively decreased for successively higher numbered shafts; wherein the mandrel butt length is progressively increased for successively higher numbered shafts.

6. A method for manufacturing first and second club shafts for a matched set of golf clubs, the method comprising the steps of:

providing first and second mandrels, each mandrel having a mandrel butt section, a mandrel tip section, and a mandrel tapered section therebetween, the mandrel butt section having a substantial constant diameter, the mandrel tip section including an upper section having a substantially constant diameter; wherein the three sections of the first mandrel differ from the three sections of the second mandrel;

providing first and second groups of patterns,;

forming the first club shaft by wrapping the first group of the patterns around the first mandrel; and forming the second club shaft by wrapping the second group of patterns around the second mandrel.

7. The method of claim 6 wherein each pattern of the first group has a first pattern length and each pattern of the second group has a second pattern length; wherein the first pattern length differs from the second pattern length.

8. A method for manufacturing a particular club shaft for a matched set of golf clubs which comprises the steps of:

selecting a particular mandrel from a set of mandrels, each mandrel in the set being formed with a mandrel butt section, a mandrel tip section and a mandrel tapered section therebetween, the mandrel butt section having a substantially constant diameter, the mandrel tip section including an upper section having a substantially constant diameter; wherein, the particular mandrel is specifically dimensioned for the particular club shaft and each section of the particular mandrel differs from each section of each of the other mandrels in the set of mandrels;

providing a particular group of patterns for each mandrel; and wrapping the patterns from the particular group around the particular mandrel to form the particular golf club shaft.

9. The method of claim 8 wherein the step of providing a particular group of patterns includes the step of selecting the particular group of patterns from a set of groups of patterns, wherein, the particular group of patterns is specifically dimensioned for the particular club shaft and differs from the remaining groups in the set of groups of patterns.

10. A method for manufacturing a club shaft, the method comprising the steps of:

providing a mandrel, the mandrel having a mandrel butt section, a mandrel tapered section, and a mandrel tip section, the mandrel butt section having a substantially constant diameter, the mandrel tip section including an upper section having a substantially constant diameter;

providing a group of patterns, each pattern in the group having a pattern length;

providing at least one weighted segment, the weighted segment having a weighted segment length which is less than the pattern length, the weighted segment having a mass which is at least approximately one hundred and fifty percent greater than graphite; and forming the club shafts by wrapping the weighted segment around substantially only the mandrel tapered section, proximate the mandrel tip section and wrapping the patterns of each group around the mandrel.

11. The method of claim 10 wherein the step of providing the weighted segment includes providing a weighted segment which includes a metallic material in an epoxy resin film.

12. A set of club shafts comprising:

a plurality of sequentially numbered, substantially tubular shafts, each shaft having a shaft butt section, a shaft tip section and a shaft tapered section, the shaft butt section of each shaft having a substantially constant diameter, the shaft tip section of each shaft including an upper section having a substantially constant diameter, each shaft tapered section having a shaft tapered length, wherein the shaft tapered length is progressively decreased for successively higher numbered shafts in the set of club shafts;

wherein each of the shafts is made by wrapping a plurality of patterns around a mandrel; and wherein each shaft tip section has a shaft tip wall thickness and the shaft tip wall thickness is progressively decreased for successively higher numbered shafts in the set of club shafts, each shaft butt section includes a shaft butt wall thickness and the shaft butt wall thickness is progressively increased for successively higher numbered shafts in the set of club shafts, and each shaft butt section includes a shaft butt length and the shaft butt length is progressively increased for successively higher numbered shafts in the set of club shafts.

13. A set of club shafts for a matched set of golf clubs, the club shafts comprising a plurality of substantially tubular shafts, each shaft having a shaft butt section, a shaft tip section and a shaft tapered section; the shaft butt section for each shaft having a substantially constant diameter, the shaft tip section for each shaft including an upper section having a substantially constant diameter; wherein the shaft butt, tapered and tip sections of each shaft differs from the corresponding shaft butt, tapered and tip sections for each of the other shafts.

14. The set of club shafts of claim 13, wherein each shaft tip section has a shaft tip wall thickness and the shaft tip wall thickness is progressively decreased for successively higher numbered shafts in the set of club shafts.

15. The set of club shafts of claim 13 wherein each shaft tapered section has a shaft tapered length and the shaft tapered length is progressively decreased for successively higher numbered shafts in the set of club shafts; and wherein each shaft butt section includes a shaft butt length and the shaft butt length is progressively increased for successively higher numbered shafts in the set of club shafts.

16. The set of club shafts of claim 13 wherein each shaft butt section includes a shaft butt wall thickness and the shaft butt wall thickness is progressively increased for successively higher numbered shafts in the set of club shafts.

* * * * *

UNITED STATES PATENT AND TRADEMARK OFFICE

CERTIFICATE OF CORRECTION

PATENT NO. : 5,924,936

DATED : July 20, 1999

INVENTOR(S) : Carter Penley

It is certified that error appears in the above-identified patent and that said Letters Patent is hereby corrected as shown below:

Column 9, Table C, First Column, Item No. 7
DELETE
[Na. 7]
INSERT
--No. 7--

Column 9, Table C, Last Column, Item No. 8
DELETE
[36 5]
INSERT
--36.5--

Column 11, Line 21
DELETE
[stop]
INSERT
[step]

Signed and Sealed this

Twenty-eighth Day of December, 1999

*Attest:*

Q. TODD DICKINSON

*Attesting Officer*

*Acting Commissioner of Patents and Trademarks*